United States Patent [19]

Hanna

[11] Patent Number: 4,669,905

[45] Date of Patent: Jun. 2, 1987

[54] MARKING APPARATUS

[76] Inventor: John E. Hanna, 8113 Nancy, Prescott, Ariz. 86301

[21] Appl. No.: 775,384

[22] Filed: Sep. 12, 1985

[51] Int. Cl.[4] ..... B05C 1/10; B05C 17/02; B43L 13/00

[52] U.S. Cl. ..... 401/208; 33/36; 101/111; 101/328; 101/329

[58] Field of Search ..... 401/208, 198, 48; 101/73–75, 328–330, 367, 331, 111; 33/34–36, 37, 413, 414; 118/260; 47/1.5

[56] References Cited

U.S. PATENT DOCUMENTS

| | | | |
|---|---|---|---|
| 1,084,609 | 1/1914 | Clark | 101/328 X |
| 1,195,199 | 8/1916 | Fullerton et al. | 101/111 |
| 1,507,595 | 9/1924 | Goode | 47/1.5 |
| 2,130,356 | 9/1938 | Marshall | 101/328 X |
| 2,312,136 | 2/1943 | Triest | 101/328 |
| 2,634,676 | 4/1953 | McKay | 101/329 X |
| 2,832,284 | 4/1958 | Farkas | 101/111 |
| 3,006,273 | 10/1961 | Sommer | 101/328 X |
| 3,046,884 | 7/1962 | Pearson | 33/36 |
| 3,537,394 | 11/1970 | Swapp | 101/328 |
| 3,577,918 | 5/1971 | Wayfield | 101/328 |
| 3,616,541 | 11/1971 | Crayton | 33/35 |
| 3,783,785 | 1/1974 | Frank et al. | 101/328 X |
| 3,896,725 | 7/1975 | Grover | 33/36 X |
| 3,988,835 | 11/1976 | Thornton | 33/36 |
| 4,112,536 | 9/1978 | Carson, Jr. et al. | 401/208 X |
| 4,147,441 | 4/1979 | Harrison et al. | 401/208 |
| 4,164,744 | 8/1979 | Freude | 101/328 X |
| 4,372,049 | 2/1983 | Hogue | 101/328 X |
| 4,389,812 | 6/1983 | Panttaja | 47/1.5 |

FOREIGN PATENT DOCUMENTS

| | | | |
|---|---|---|---|
| 467977 | 12/1951 | Italy | 401/208 |
| 18898 | of 1893 | United Kingdom | 33/414 |

*Primary Examiner*—Steven A. Bratlie

*Attorney, Agent, or Firm*—Don J. Flickinger; Jordan M. Meschkow

[57] ABSTRACT

A spool of pervious material impregnated with a marking medium, such as ink, is carried within a drum. The material extends from the spool through a passageway in the drum, such a segment of the material extends longitudinally along the exterior surface of the drum. As the drum is rolled along a surface, marks are made at predetermined, regularly spaced intervals. The supply of marking medium is replenished by drawing a successive segment of material from the spool.

12 Claims, 6 Drawing Figures

MARKING APPARATUS

BACKGROUND OF THE INVENTION

1. Field of the Invention

This invention relates to marking apparatus.

More particularly, the instant invention relates to devices for making marks at predetermined intervals along a surface.

In a further and more specific aspect, the present invention concerns a marking device having improved means for convenient replenishment of the marking medium.

2. The Prior Art

There exists a frequent and repetitive demand for indicating a plurality of equally spaced distances upon a selected surface. Exemplary is the building construction art, wherein there is a continuing need to mark upon one member the proposed locations of respective second members. Particularly noted is the laying out of a horizontal member, such as a sill or plate, to which upright members, studs, are to be affixed.

Traditionally, the lay out has been accomplished by measuring and marking. For example, a tape measure or other measuring instrument is extended along the layout surface and then marks are made at predetermined intervals upon the surface with a pencil. Under ideal conditions, the procedure is laborious and time consuming. Further, as will be readily recognized by those skilled in the art, the method includes an inherent tendency toward inaccuracy.

In attempts to simplify the process and insure accuracy, the prior art has devised various proported solutions. In general, the proposed devices have taken the form of a handled roller or drum which can be rolled along the layout surface. Means, carried by the drum, are provided for making periodic marks upon the surface. A common marking means is a porous member or wick which deposits marking fluid or ink as it is brought into rolling contact with the surface.

While substantially reducing the possibility of human error associated with inaccurately reading the measuring scale or erroneous mathematical calculation, the prior art devices have not proven to be entirely satisfactory. For example, replenishing the supply of ink or marking fluid remains a tedious and potentially messy task. Many of the devices tend to be unduly complex, therefore, unwieldy and difficult to operate. Other inadequacies will be readily noted by those having potential need for such apparatus.

It would be highly advantageous, therefore, to remedy the foregoing and other defficiencies inherent in the prior art.

Accordingly, it is an object of the present invention to provide improvements in the art of laying out and marking.

Another object of the invention is the provision of an improved marking apparatus of the type having a drum which is rolled along the layout surface to be marked.

And another object of the invention is to provide improved marking means carried by the drum for making a series of marks at predetermined intervals along the layout surface.

Still another object of the instant invention is the provision of means for expeditious and convenient replenishment of the marking medium.

Yet another object of the invention is to provide a marking apparatus having an ameliorated reserve supply of marking medium.

Yet still another object of this invention is the provision of a marking apparatus which is usable with various marking media, either liquid or dry.

A further object of the invention is to provide a marking apparatus in which the marking means is in the form of a readily replacable cartridge.

And a further object of the immediate invention is the provision of an easily usable marking apparatus of simplified design and construction.

Still a further object of the invention is to provide a marking apparatus that is compact and lightweight for convenient storage and use.

Yet a further object of the invention is an improved marking apparatus, according to the foregoing, which is relatively maintenance free and comparatively inexpensive to manufacture.

SUMMARY OF THE INVENTION

Briefly, to achieve the desired objects of the instant invention, in accordance with a preferred embodiment thereof, provided is a drum having a cylindrical outer surface and rollable along the layout surface to be marked. Next provided is an elongate marking member carrying the marking medium and engagement means releasably securing the marking member to the drum. The engagement means holds the marking member such that a segment thereof extends substantially longitudinally along the outer surface of the drum for contact with the layout surface.

In accordance with a further embodiment of the invention, a storage compartment is formed within the drum for containing a replenishment supply of the marking member which is preferably in the form of an elongate flexible pervious element having the marking medium impregnated therein. The marking member extends through a passageway communicating between the storage compartment and the exterior of the drum. The engagement means further includes a first groove communicating with the passageway for receiving the marking member therefrom and a second groove spaced longitudinally along the drum from the first groove.

In accordance with a more specific embodiment, there is provided a spool for holding a coiled quantity of the replenishment supply of marking medium. Further provided are means for rotatably supporting the spool within the storage compartment. Also provided is a channel extending laterally of the outer surface of the drum for locationally retaining the exposed segment of the marking member.

BRIEF DESCRIPTION OF THE DRAWINGS

The foregoing and further and more specific objects and advantages of the instant invention will become readily apparent to those skilled in the art from the following detailed description of a preferred embodiment of the instant invention, in which.

DETAILED DESCRIPTION OF THE PREFERRED EMBODIMENT

Figure 1:
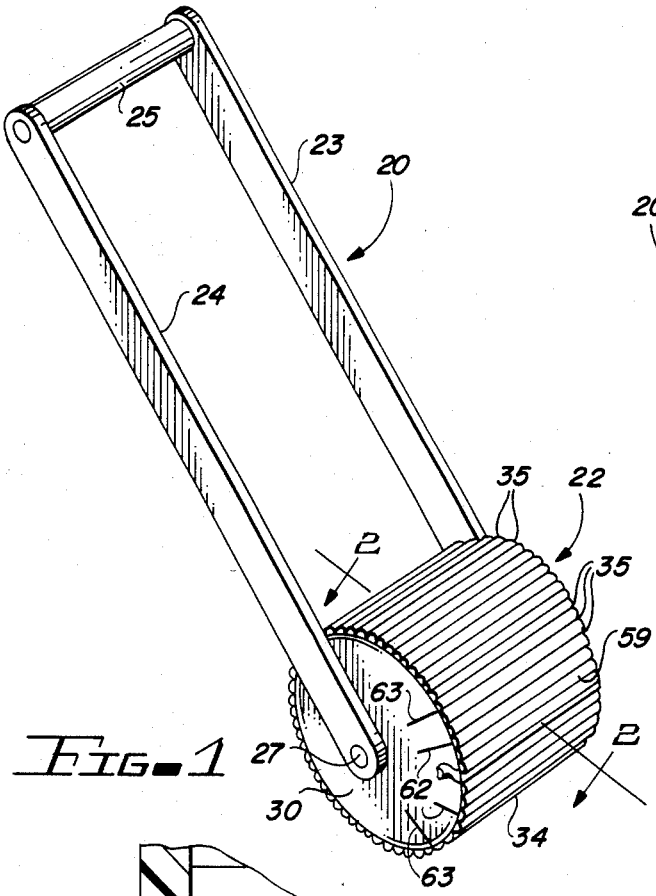
FIG. 1 is a perspective view of a marking apparatus constructed in accordance with the teachings of the instant invention.

Turning now to the drawings in which like reference characters indicate corresponding elements throughout the several views, attention is first directed to FIG. 1 which illustrates a marking apparatus embodying the teachings of the instant invention and including handle means generally designated by the reference character 20 rotatably coupled to a roller or drum generally designated by the reference character 22. Handle means 20, further seen with reference to FIG. 2, includes a pair of elongate members 23 and 24 held in spaced apart relationship by lateral members 25 and 27. Lateral member 25 functions as a hand grip while lateral 27 functions as an axle upon which drum 22 is rotatably journaled. While handle means 20 may assume any desired configuration, it is preferred for purposes of simplicity of manufacture, that members 23 and 24 are identical as are lateral members 25 and 27.

Figure 2:
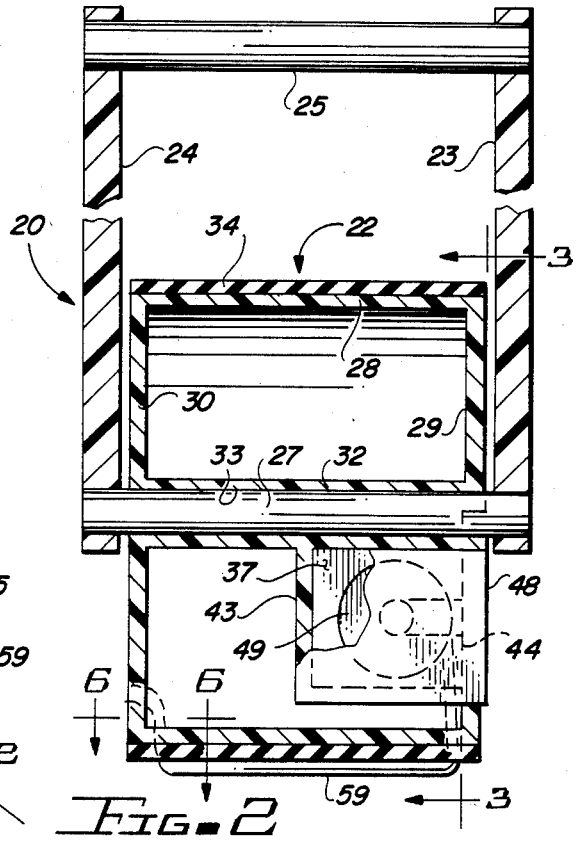
FIG. 2 is an enlarged fragmentary sectional view taken along the line 2—2 of FIG. 1.

With further reference to FIGS. 1 and 2, it is seen that drum 22 in accordance with the immediately preferred embodiment is a generally hollow structure defined by cylindrical side wall 28 and end walls 29 and 30. Tubular element 32 coaxial with cylindrical side wall 28, includes bore 33 which is rotatably journaled upon lateral member 27.

Pursuant to the foregoing description, it will be appreciated that the apparatus of the instant invention may be manually grasp by lateral member 25 and moved causing drum 22 to roll along the layout surface to be marked. The device is readily fabricated of various selected metallic or plastic materials. To insure rolling contact and prevent sliding of the drum upon the layout surface, it is preferred that cylindrical side wall 28 be encased in a sleeve 34 of friction enhancing material such as butyl or neoprene. Further, the exterior surface of sleeve 34 may be embossed with a pattern or regularly spaced longitudinally extending ribs 35.

Sleeve 34, more particularly ribs 35, function as the cylindrical outer surface of drum 22. The circumference of the outer surface of drum 22 corresponds to the intervals to be marked. In otherwords, the circumference is equal to the distance between adjacent marks. In accordance with conventional practice, studs, trusses and other building members are usually placed upon either sixteen inch or twenty-four centers. Accordingly, the device of the instant invention may be provided with drums of corresponding circumference.

Figure 3:
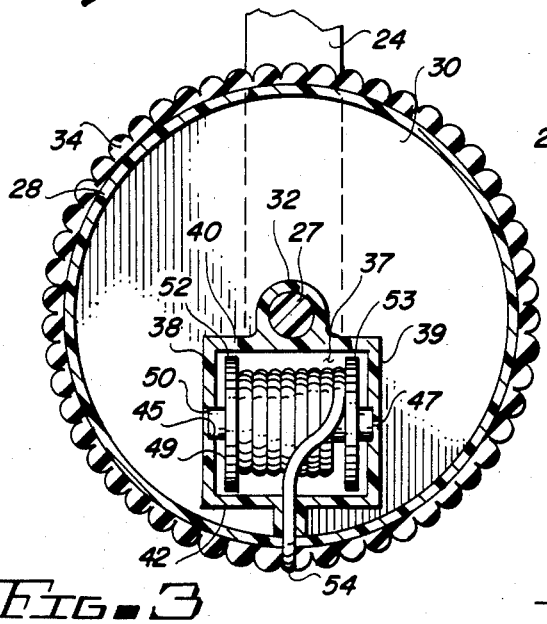
FIG. 3 is a fragmentary vertical sectional view taken along the line 3—3 of FIG. 2.
Figure 5:
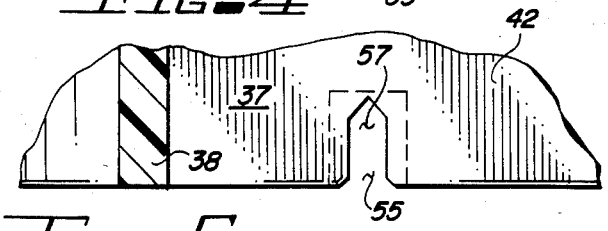
FIG. 5 is a fragmentary horizontal view taken along the line 5—5 of FIG. 4.

A compartment 37, as seen with reference to FIGS. 2 and 3, is formed in drum 22. In accordance with the immediately preferred embodiment of the invention, compartment 37 is defined by spaced apart side walls 38 and 39, respectively, top wall 40, bottom wall 42 and inner wall 43. Open end 44, opposite inner wall 43, projects through end wall 29 of drum 22. Opposing grooves 45 and 47 are carried by side walls 38 and 39, respectively. The grooves extend to the open end 44. Cap 48 is frictionally engagable within open end 44 to close compartment 37.

Spool 49 is removably and replaceably held within compartment 37. Being of conventional design, spool 49 includes mandrel 50 from which project spaced apart radial flanges 52 and 53. Terminal portions of mandrel 50 projecting beyond flanges 52 and 53 are received within the respective grooves 45 and 47. Accordingly, spool 50 is rotatably supported within compartment 37.

A supply of marking member 54 is carried by spool 49. Preferably, the marking member includes an elongate flexible pervious element, such as a cord, which is impregnated with a liquid or particulate marking medium such as ink or chalk dust. The member is coiled about mandrel 50 intermediate flanges 52 and 53 in accordance with conventional technique.

Figure 6:
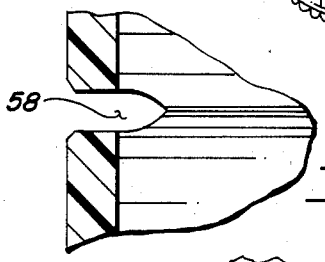
FIG. 6 is an enlarged fragmentary horizontal sectional view taken along the line 6—6 of FIG. 2.
Figure 4:
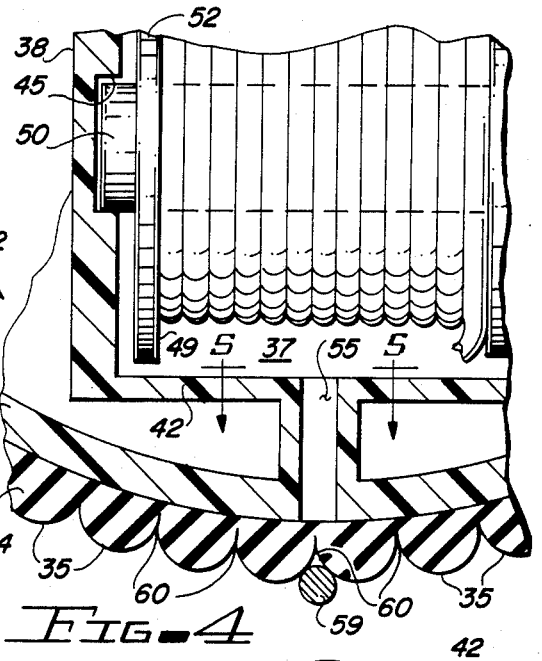
FIG. 4 is an enlarged fragmentary sectional view generally corresponding to the lower central portion of the illustration of FIG. 3.

A passageway 55, as best seen in FIG. 4, communicates between compartment 37 and the exterior of drum 22. Passageway 55 is sized to receive marking member 54 therethrough. Inboard of passageway 55 is groove 57 which is sized to frictionally receive member 54. It is noted that passageway 55 and groove 57 are proximate end wall 29 of drum 22. A similar groove 58 is formed into drum 22 proximate side wall 30 in lateral alignment with groove 57 as viewed in FIG. 6.

Again referring to FIG. 2, it is seen that a predetermined length of marking element 54 may be withdrawn from storage compartment 37 through passageway 55 after which the member is moved inwardly for retension within groove 57. Subsequently, the length of marking member 54 is extended laterally across the outer surface of drum 22 and the terminal end engaged within groove 58. Grooves 57 and 58 function as first and second elements, respectively, for engagably receiving a portion of the marking member. Segment 59 of marking member 54 residing intermediate the grooves 57 and 58 contacts the layout surface for deposit of the marking medium as it is compressed between drum 22 and the layout surface.

An impression 60 resides between each adjacent rib 35. The impression 60 residing intermediate the grooves 57 and 58, functions as a channel for locationally retaining the segment 59 of marking member 54. Hence, the mark impressed upon the layout surface is substantially perpendicular to the direction of travel of the marking device of the instant invention. Alternately, a laterally extending channel may be cut at the desired location for the purpose of locationally retaining segment 59.

After the marking medium is expended from segment 59, the supply is replenished by disengaging member 54 from notches 58 and 55, withdrawing a replenishment supply from reel 49 and re-engaging the member as described above. The expended segment is readily severed proximate notch 58. To prevent loss of the marking medium during handling and storage, the spool of marking medium may be packaged within an impervious casing.

An intended use of the immediate device is the marking of center-to-center locations for construction members such as studs. Such members present a width and a thickness to the layout surface. Carried by drum 22 is indicia to indicate the position of the outer edges of the member, either thickness or width, relative the centerline as marked by the segment 59. With reference to FIG. 1, there is seen a first set of indicia, lines 62, carried on side wall 30 and equally spaced from segment 59. The circumferencial distance between lines 62 corresponds to the thickness of the construction member. A second set of indicia, lines 63, similarly correspond to the width of the construction member. If desired, the location of boundries of the construction member may be marked upon the layout surface by an appropriate instrument, such as a pencil, as the respective lines are brought into tangency with the layout surface.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described and disclosed the present invention, and alternately preferred embodiments thereof, in such clear and concise terms as to enable those skilled in the art to understand and practice the same, the invention claimed is:

1. An apparatus for making marks at predetermined intervals by periodically impressing a marking medium upon a layout surface and especially adapted for convenient replenishment of the marking medium, said apparatus comprising:

a. a drum having a cylindrical outer surface and rollable along said layout surface;

b. an elongate marking member carrying said marking medium;

c. engagement means releasably securing said marking member to said drum, at least a segment of said marking member extending substantially longitudinally along the outer surface of said drum for contact with said layout surface; and d. storage means within said drum for carrying a replenishment supply of said marking member and said marking medium.

2. The apparatus of claim 1, wherein said marking member includes an elongate, flexible pervious element having said marking medium impregnated therein.

3. The apparatus of claim 2, wherein storage means includes:

a. a storage compartment formed within said drum; for containing said replenishment supply of said marking member; and b. a passageway communicating between said storage compartment and the exterior of said drum for receiving said marking member therethrough.

4. The apparatus of claim 3, wherein said engagement means includes:

a. a first element for engagably receiving a portion of said marking member proximate one end of said segment; and b. a second element for engagably receiving a portion of said marking member proximate the other end of said segment.

5. The apparatus of claim 4, wherein:

a. said first element of said engagement means includes a first groove communicating with said passageway for receiving said marking member therefrom; and b. said second element includes a second groove spaced longitudinally along said drum from said first groove.

6. The apparatus of claim 3, further including a spool for holding a coiled quantity of said replenishment supply of said marking member.

7. The apparatus of claim 6, further including means for rotatably supporting said spool within said storage compartment.

8. The apparatus of claim 1, further including a channel extending laterally of the outer surface of said drum for locationally retaining said segment of said marking member.

9. The apparatus of claim 1, further including handle means rotatably coupled to said drum for manually urging said drum along said layout surface.

10. The apparatus of claim 1, further including indicia carried by said drum for indicating a location upon said layout surface at a predetermined distance from the mark impressed by said marking member.

11. The apparatus of claim 2, wherein said marking medium is liquid.

12. The apparatus of claim 1, wherein said marking medium is particulate.

* * * * *